US007311417B1

(12) United States Patent
Lemke

(10) Patent No.: US 7,311,417 B1
(45) Date of Patent: Dec. 25, 2007

(54) WATERPROOF FLASHLIGHT INCLUDING ELECTRONIC POWER SWITCH ACTUATED BY A MECHANICAL SWITCH

(75) Inventor: Guido A. Lemke, Hopewell Junction, NY (US)

(73) Assignee: Ocean Management Systems Inc., Middletown, NY (US)

( * ) Notice: Subject to any disclaimer, the term of this patent is extended or adjusted under 35 U.S.C. 154(b) by 174 days.

(21) Appl. No.: 11/061,703

(22) Filed: Feb. 22, 2005

(51) Int. Cl.
*F21L 4/00* (2006.01)
*F21V 31/00* (2006.01)

(52) U.S. Cl. ..... 362/158; 362/205; 362/208

(58) Field of Classification Search ..... 362/158, 362/205, 208
See application file for complete search history.

(56) References Cited

U.S. PATENT DOCUMENTS

| | | | | | |
|---|---|---|---|---|---|
| 1,875,956 | A | | 9/1932 | Thiel | |
| 2,444,107 | A | | 6/1948 | Montgomery | |
| 3,162,376 | A | * | 12/1964 | Syoichi | 362/158 |
| 3,535,506 | A | | 10/1970 | Moore et al. | |
| 3,790,912 | A | * | 2/1974 | Murphy | 335/205 |
| 3,794,825 | A | * | 2/1974 | Krupansky | 362/158 |
| 4,152,755 | A | * | 5/1979 | Trosper et al. | 362/158 |
| 4,171,534 | A | | 10/1979 | Strowe | |
| 4,458,299 | A | * | 7/1984 | Stephens et al. | 362/158 |
| 4,678,450 | A | * | 7/1987 | Scolari et al. | 446/405 |
| 5,806,964 | A | | 9/1998 | Maglica | |
| 6,239,555 | B1 | * | 5/2001 | Rachwal | 315/200 R |
| 6,388,390 | B2 | * | 5/2002 | Rachwal | 315/200 R |
| 6,547,414 | B2 | * | 4/2003 | Steger | 362/188 |
| 6,802,621 | B2 | * | 10/2004 | Adeler | 362/157 |
| 6,841,941 | B2 | * | 1/2005 | Kim et al. | 315/86 |
| 7,101,057 | B2 | * | 9/2006 | Parker et al. | 362/191 |

FOREIGN PATENT DOCUMENTS

GB 2161024 A * 1/1986

* cited by examiner

*Primary Examiner*—Jong-Suk (James) Lee
*Assistant Examiner*—Ismael Negron
(74) *Attorney, Agent, or Firm*—Schweitzer Cornman Gross & Bondell LLP

(57) ABSTRACT

A flashlight has front and rear interconnected housing portions which define an interior waterproof chamber. The waterproof chamber carries an illumination source, an electronic drive for the illumination source and a power source. A switch system includes an electronic switch component for switching the relatively high current required for the electronic drive while a mechanical switch (e.g. a magnetic reed switch) activates the electronic switch component, therefore maintaining integrity of the waterproof seal about the chamber. A commutator assembly is provided to maintain electrical contact between the switch and other components. The power supply may be in the form of a plurality of battery stacks batteries aligned in the housing in a manner to provide a compact unit, while electrical components may be mounted to circuit boards positioned transversely to the length of the flashlight.

8 Claims, 4 Drawing Sheets

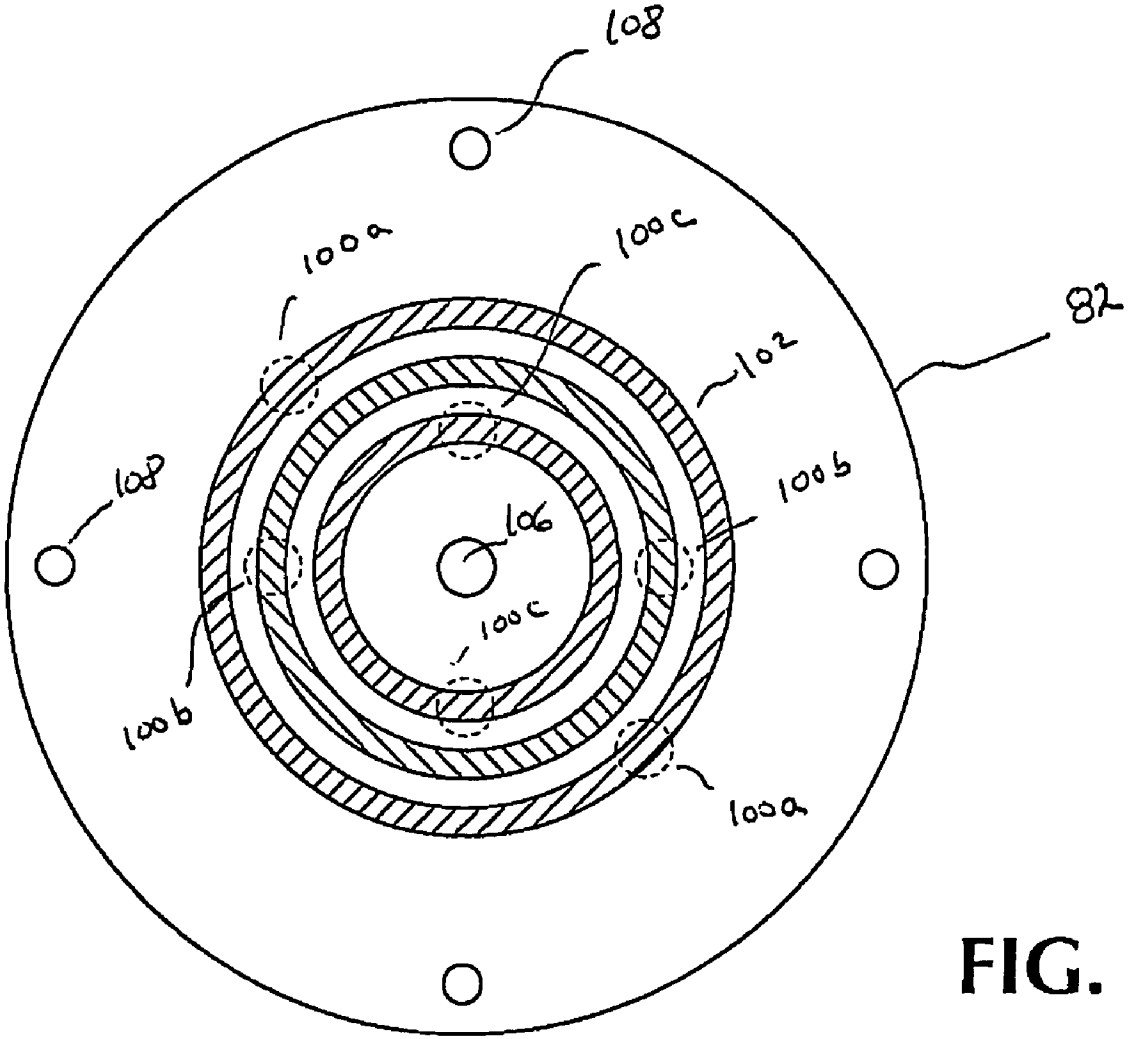
28
108
108
108

WATERPROOF FLASHLIGHT INCLUDING ELECTRONIC POWER SWITCH ACTUATED BY A MECHANICAL SWITCH

The present invention relates to a flashlight or illumination device and in particular to such a device which is of a waterproof construction and thus of applicability for use by scuba divers and the like.

BACKGROUND OF THE INVENTION

The use of flashlights and related illumination equipment to provide underwater lighting is well known. With the inclusion of a portable power supply, such as a battery pack, a diver is able to carry with him a safe, stable illumination source to provide visibility in the dark and murky depths. Conventional underwater lighting has long utilized incandescent bulbs as a light source. Such bulbs can be driven directly by a battery pack and thus provide minimal difficulties in being installed in a watertight housing.

Incandescent bulbs, however, have shortcomings. The light normally generated is of a yellow, rather than white, character, and is often of relatively poor intensity. In addition, such bulbs are inefficient light generators. To combat such deficiencies, miniature high-intensity discharge (HID) bulbs are replacing incandescent bulbs for use in underwater flashlights. The use of such HID devices, however, is not without its own shortcomings. In particular, while such bulbs have improved light output and energy efficiency, they require a ballast and drive circuitry to properly condition and regulate the voltage source.

Many HID underwater lights are of a two-piece construction, having the lamp and drive circuitry in a first, hand-held housing, and a battery power supply in a second housing. Electrical connections between the two housings and the enclosed components are through a cable. While such two-piece construction allows the lamp heads to be of relatively small dimensions, the presence of a connecting cable can be an impediment to use. In addition, the diver must still tether the battery pack in some manner.

It is accordingly a purpose of the present invention to provide a new and improved waterproof flashlight construction utilizing HID lighting in which the light source and power supply are in a single unit.

It is a further purpose of the present invention to provide such a flashlight which is of a compact construction.

Yet a further purpose of the present invention is to provide such a portable flashlight having the capability of convenient battery exchange and replacement.

SUMMARY OF THE INVENTION

In accordance with the foregoing and other objects and purposes, an underwater flashlight of the present invention comprises a main housing portion having an inner compartment or cavity. An illumination source located at a first end of the cavity with a clear lens forming a waterproof first end seal thereat, while the drive cavity and a replaceable battery power supply are located behind the illumination source. The rear end of the cavity is sealed by a removable rear cap which provides access to the batteries and contains a main electrical switch for the flashlight. When the cover is in place, the switch is electrically connected to the batteries and drive circuitry.

To maintain the waterproof nature of the flashlight, the switch is preferably of the type in which external mechanical switching action is transferred in a non-contact manner to the switch's electrical contacts. In a particularly preferred embodiment the switch comprises a magnet, an electrical reed switch, and an electronic switch element capable of carrying the relatively high currents required by the drive circuitry while keeping the current flow through the reed switch, which is a low current capacity device, to acceptable levels.

To provide a compact construction for the flashlight, the battery power supply may comprise a plurality of individual batteries arranged in co-linear adjacent stacks within the body cavity. Continuity between the battery stacks is accomplished through a commutator assembly, which allows electrical contact to be developed and maintained between switch circuitry and the batteries irrespective of the precise orientation of the rear cap with respect to the main body. Transversely-mounted circuit boards both carry electrical components and provide interconnections between the components and the batteries.

BRIEF DESCRIPTION OF THE DRAWINGS

A fuller understanding of the present invention will be obtained upon review of the following, detailed description of a preferred but nonetheless illustrative embodiment thereof, when reviewed in conjunction with a the annexed drawings, wherein:

FIG. 4 is a plan view of the commutator ring portion of the commutator assembly

DETAILED DESCRIPTION OF THE INVENTION

Figure 2A:
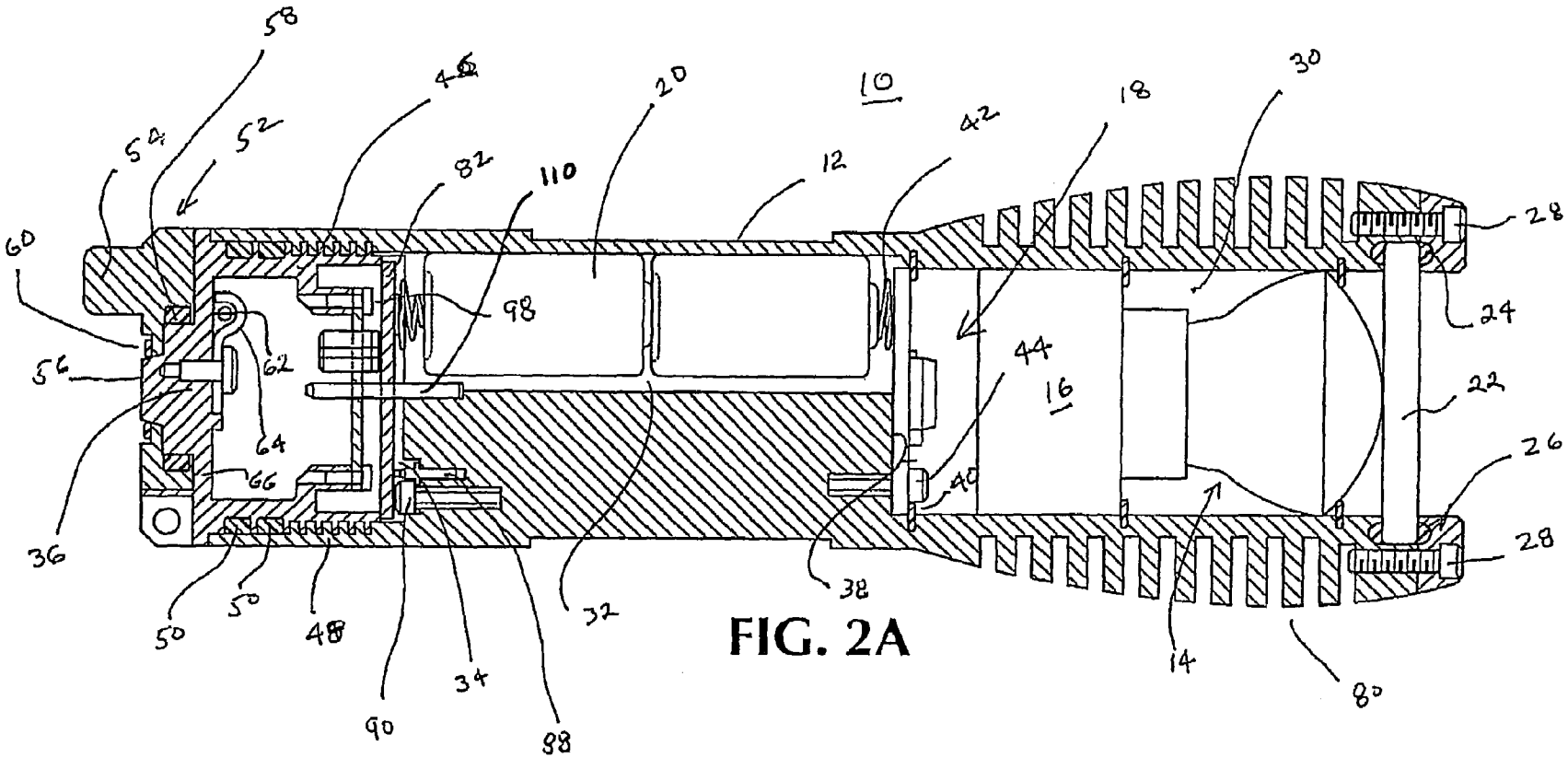
FIG. 2A is a cross-sectional view of a flashlight constructed in accordance with the invention.

With initial reference to FIG. 2A, flashlight 10 includes a main, generally cylindrical housing 12 defining an interior space or cavity in which illumination source 14, ballast 16, drive electronics board 18, and batteries 20 are located. The housing 12 is preferably constructed of an appropriate durable metal, such as an anodized aluminum alloy, which allows it to serve as a circuit element, while providing both corrosion resistance and heat dissipation. The front end of the housing carries lens 22, which is held to the front of the housing by retaining ring 26 which is affixed to the front of the housing by bolts 28. A gasket assembly 24 seals the lens from water entry. The housing may be preferably milled out of a solid piece of stock with a forward cavity portion 30 for the bulb ballast and drive electronics board; three parallel cavity portions 32, each dimensioned to receive a stack of batteries 20; and a rear, open-ended cavity portion 34, which accepts the rear cap 36. Each of the battery cavity portions 32 connects with forward cavity portion 30 and rear cavity portion 34. Drive electronics board 18 bearing the drive circuitry for the bulb and ballast is mounted transversely to the length of the flashlight and is mounted at the rear end of the first cavity. It is maintained in a flush position against the rear wall surface 38 of the first cavity by a C-ring 40. Bolt 44 provides electrical contact between a trace on the printed circuit board and main body portion 12, as will be explained infra, as well as providing additional retention for the board. The rearwardly-facing surface of the printed circuit board also bears spring contacts 42 to establish electrical connection with the battery stacks in each of the battery cavity portions 32.

Figure 3:
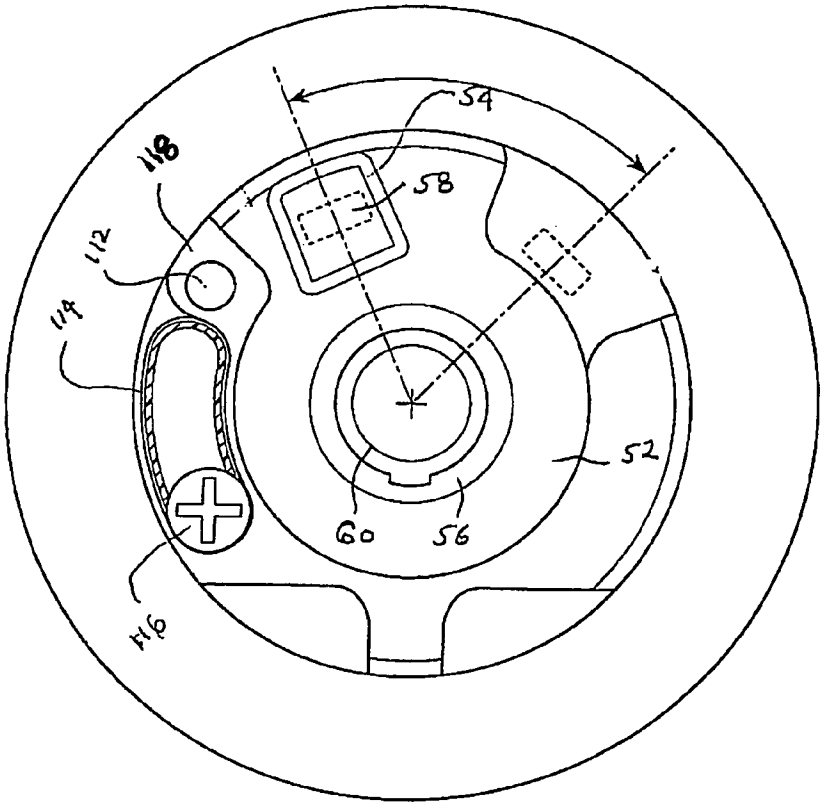
FIG. 3 is an end view of the flashlight depicting the power switch.

Rear cap 36, which may similarly be of anodized aluminum, includes externally-threaded, generally cylindrical side wall 46 which threadedly engages a complimentary threaded inner surface portion 48 of the housing 12 which defines the rear cavity 34. A pair of O-rings 50 mounted on the cap side wall 46 establish a watertight seal between the rear cap and the housing. The rear cap 36 carries the main power switch for the flashlight while maintaining a watertight seal for the housing interior cavity. As shown, rotatable main switch 52, which includes rearwardly-extending operating knob 54, is rotatively mounted on the exterior of the rear cap about central hub 56. The switch is rotatable about an arc of approximately 50 degrees, as shown in FIG. 3, the end points of rotation defining "on" and "off" positions. The switch carries with it magnet 58, affixed in an inner recess in the switch, which rotates into and out of proximity to magnetic reed switch 62, which is mounted by clamp 64 to the inner surface of the transverse wall portion 66 of the rear cap. With the magnet 58 positioned adjacent the reed switch, the reed switch contacts close, creating electrical continuity though the switch, while when the magnet is rotated away from proximity to the switch, the switch contacts open. Accordingly, electrical switching can be performed without physical contact or access to the sealed interior of the flashlight.

Figure 1:
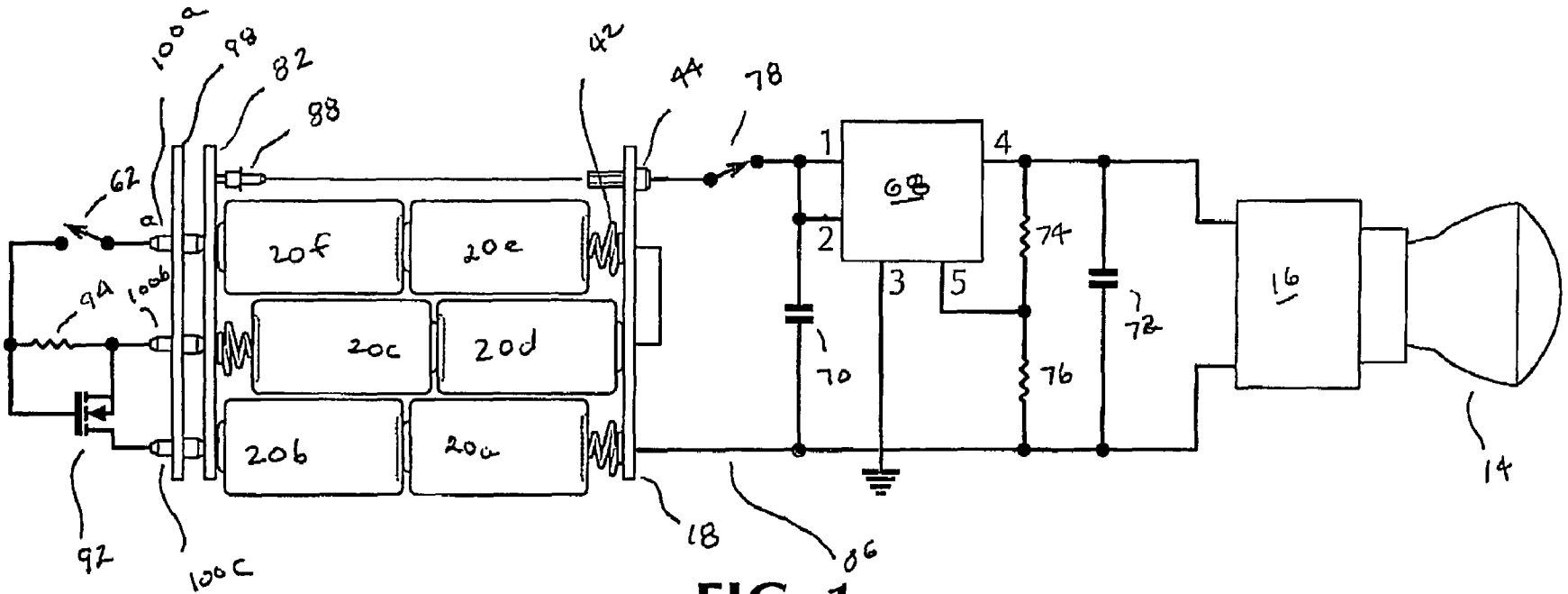
FIG. 1 is a schematic representation of the flashlight's electrical system.

With reference to FIG. 1, illumination source 14 is a miniature HID bulb, such as that sold under the SOLARC trademark by Welch Allyn. As known in the art, ballast 16 provides a controlled drive current for the lamp, including the generation of an initial higher voltage spike required to "strike" the arc in the bulb. The ballast may be, for example, the Welch Allyn B10N003 unit.

Electrical power for the ballast and bulb is derived from batteries 20*a-f*. Three stacks of two cells each are wired in a series arrangement. The batteries are preferably 2.5-volt rechargeable nickel-cadmium cell units, providing a total nominal output voltage of 15 volts. Voltage regulator 68 is used to provide a stable input voltage to the ballast and bulb. The voltage regulator may be, for example, a 14.5 volt output unit. Input and output side capacitors 70 and 72, respectively and bias resistors 74 and 76 are chosen as known in the art. Thermal cut-out switch 78, in series with the positive voltage input to the regulator, is provided to cut power in the event of overheating. It may, for example, be of bimetallic design having a cut-out temperature of approximately 40° C., thereby assuring that the body of the light remains safe to touch. In this regard, it is to be noted that the exterior surface 80 of the forward end of housing 12 may be of a ribbed or fin-like configuration to provide increased surface area and thus improve heat transfer and dissipation to the surrounding atmosphere. The voltage regulator 68 and the associated components are mounted upon drive electronics board 18.

The three stacks of the batteries 20 are positioned between drive electronics board 18 and rear contact board 82. Electrical continuity between the negative or ground end of the full battery stack and the drive circuitry is established by line 86, while continuity between the positive end and the drive circuitry is established through the flashlight housing. Bolt 44 provides the link to the housing from main board 18, while a spring-loaded contact 88, inserted into a mating bore in the body and contacting a corresponding circuit trace on rear board 82, couples the high end of the batteries to the body. The contact 88 is retained in the bore by bolt 90 overlying a peripheral flange of the contact.

As magnetic reed switch 62 must of necessity be of small physical size, its contacts are unable to withstand the total current drawn by the regulator 68 and supplied to the ballast and bulb. Accordingly, the present invention includes a semiconductor switch or relay that operates in conjunction with the reed switch to perform main switching of the batteries and control in the load current. As may be seen in FIG. 1, P channel field effect transistor 92 has its main source-drain junction in series with the battery supply, and in particular between the anode of battery 20B and the cathode of battery 20C. Thus, when transistor 92 is in the open or non-conducting state, a high resistance appears in series with the battery stack, effectively depriving the drive circuit load of power. The operative condition of transistor 92, however, is controlled by reed switch 62. With reed switch 62 closed, the potential applied to the gate is from the anode of battery 20F at the top of the battery stack, and is higher than the potential applied to the transistor's source, due to the presence of pull down resistor 94. Accordingly, transistor 92 is turned on, and appears as a virtual short between its source and drain electrodes. Full battery voltage is thus applied to the drive circuit and the flashlight is "on". Because of the high impedance of the transistor's gate-drain junction and the parallel resistance of pull-down resistor 94, which is a high value, the current flowing through reed switch 62 is minimal. With reed switch 62 open, the potential applied to the source and gate is that of the left or cathode end of battery 20C, and the transistor's gate is lower than that of its source by virtue of resistor 94. The transistor is thus maintained in the off state, with a high resistance path between source and drain to interrupt the battery circuit.

Because reed switch 62, transistor 92 and pull-down resistor 94 are mounted to the transverse wall portion 66 of the rear cap, and the rear cap is threadedly mounted to the housing, it is necessary to provide means to establish and maintain electrical contact between the switch circuitry and the battery stacks, irrespective of the final radial orientation of the rear cap with respect to the body when the rear cap is installed. This is performed by the commutator assembly detailed in FIGS. 2B and 4.

Figure 2B:
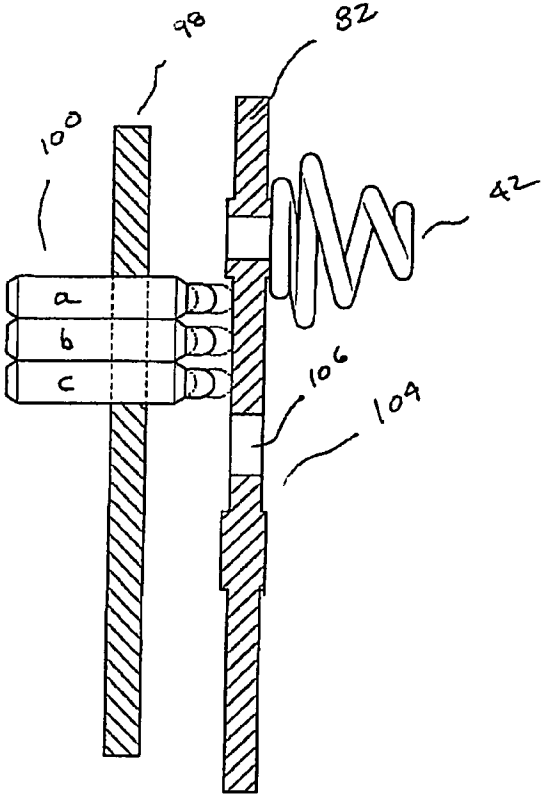
FIG. 2B is a side elevation view of the commutator assembly.

With reference to FIGS. 2B, 2A and 4, board 96 is mounted to the forward end of the rear cap, transversely to the length of the flashlight, by bolts 98. The board supports two sets of three spring-loaded contact pins 100 *a-c* which bear against concentric conductive paths or traces 102 on the rear face of contact board 82, also mounted transversely to the length of the flashlight. Each of the traces on board 82 is in electrical continuity with a battery stack through either a spring contact 42 or a contact trace 104. One pin of each set is connected to the reed switch, transistor source, and transistor gate as shown in FIG. 1. The two sets of pins may preferably be oriented in a diametrically-opposed manner, as shown in FIG. 4. For clarity only one pin set is depicted in FIG. 2B.

To afford convenient access to the batteries 20 when the rear cap is removed, contact board 82 is not permanently mounted to the main body. Rather, it is provided with a central orientation bore 106 and peripheral orientation bores 108, as seen in FIGS. 2B and 4. Guide pins 110 (only one of which is shown in FIG. 2A) are installed on the housing and support the contact board in the required transverse alignment. When the rear cap is screwed down, the spring action of the contacts 100 provide a forwardly-directed bias against the contact board, urging the battery contacts into continuity with the respective batteries and maintaining the necessary electrical contact between the board and body spring-loaded contact 88. The placement of the individual contact pins 100 about the circumference of the board insures that consistent and equal force is applied across the board to maintain alignment and prevent skewing.

With the batteries installed and contact board 82 placed on the guide pins 110, rear cap 36 is screwed into the housing, the O-rings 50 maintaining a waterproof seal between the body and cap. The precise angular orientation of the cap with respect to the housing is not critical, as the contacts 100 create electrical continuity between the switch circuitry in the cap and the contact board and batteries, irrespective of their relative orientations. With the rear cap in place, operation of the flashlight is controlled by the angular position of switch piece 52.

The rotating action of the switch piece 52 allows the flashlight to be operated, even if a diver is encumbered with diving gloves. Yet, as HID lamps are capable of generating a fair amount of heat, it is important that safeguards be provided to prevent inadvertent activation of the light, such as when it is packed away for storage. Thus, in addition to the use of thermal overload switch 78, the flashlight may include a mechanical locking mechanism to maintain the power switch in the "off" orientation as desired. With reference to FIG. 3, switch piece 52 may be provided with shoulder portion 118 carrying locking pin 112. Elastic band 114 is retained on the cap 36 by bolt 116 and can be manually stretched over the pin 112 to apply a counterclockwise bias to the switch piece 52 and thereby maintaining the switch in the "off" position. The elastic band is simply lifted off the pin 112 to allow normal switch operation to occur.

Modifications and adaptations of the invention as specifically described herein will be apparent to those skilled in the art. Accordingly, the scope of the present invention is to be determined upon reference to the claims appended hereto.

I claim:

1. A waterproof flashlight, comprising:

a forward housing portion having an electrically driven illumination source, an electronic drive coupled to the illumination source and a power source therein;

a rear housing portion removably attached to the forward portion by complementary threaded sections of the rear and forward portions to form a single waterproof chamber for at least said electronic drive and power source; and an activation switch located within a section of the waterproof chamber formed by the rear housing portion and a user-activated switch actuator for the activation switch located on the exterior of the rear portion, said activation switch comprising a mechanically-operated switch and an electronic switch coupled to the mechanically-operated switch for coupling the power source to the electronic drive, the mechanically-operated switch energizing the electronic switch when closed, the electronic switch being continuously powered by the power supply irrespective of the electrical condition of the activation switch and carrying load current for the electronic drive without said load current passing through the mechanically-operated switch, the activation switch being electrically coupled to the electronic drive irrespective of the relative angular orientation of the rear portion relative to the front portion when the rear and front portions are attached by the respective threaded sections to form the waterproof chamber.

2. The flashlight of claim 1 wherein the electronic switch is a field effect transistor.

3. The flashlight of claim 1 wherein the mechanically-operated switch is a magnetic reed switch, the switch actuator comprising a magnet.

4. The flashlight of claim 1 wherein the power source is a plurality of batteries.

5. The flashlight of claim 4 wherein the batteries are arranged in a plurality of parallel stacks extending parallel to a length of the flashlight.

6. The flashlight of claim 1 wherein a commutator comprising a series of concentric circular conductor paths on a substrate supported by one of the housing portions and a corresponding series of electrical contacts therefor supported by the other housing portions electrically couples the activation switch to the electronic drive.

7. The flashlight of claim 6 wherein the commutator provides a continuous bias voltage to the electronic switch.

8. The flashlight of claim 7 wherein the bias voltage is established through a intermediate tap to the power supply.

* * * * *